United States Patent [19]

Fremaux et al.

[11] Patent Number: 5,051,560

[45] Date of Patent: Sep. 24, 1991

[54] HEATED SECOND WINDOW IN A DOUBLE GLAZING SYSTEM

[75] Inventors: Jacques Fremaux, Bougival; Roland Brechot, Bry-Sur-Marne, both of France

[73] Assignees: Saint-Gobain Vitrage International, Courbevoie; Acome, Paris, both of France

[21] Appl. No.: 497,676

[22] Filed: Mar. 23, 1990

[30] Foreign Application Priority Data

Mar. 23, 1989 [FR] France ..... 8903809

[51] Int. Cl.[5] ..... H05B 3/10; E06B 7/12

[52] U.S. Cl. ..... 219/213; 52/171

[58] Field of Search ..... 219/213, 214, 522, 203; 52/171, 209, 172, 203, 304; 126/417; 350/17

[56] References Cited

U.S. PATENT DOCUMENTS

| | | | |
|---|---|---|---|
| 4,040,219 | 8/1977 | Budich | 52/209 |
| 4,066,815 | 1/1978 | Olink et al. | 52/171 |
| 4,273,098 | 6/1981 | Silverstein | 126/417 |
| 4,377,613 | 3/1983 | Gordon | 52/171 |
| 4,471,589 | 9/1984 | Schmidlin | 52/171 |
| 4,533,571 | 8/1985 | Kramer et al. | 427/180 |
| 4,639,069 | 1/1987 | Yatabe et al. | 350/1.7 |
| 4,641,466 | 2/1987 | Raninen et al. | 52/171 |
| 4,733,504 | 3/1988 | Lindgren | 52/1 |
| 4,918,288 | 4/1990 | Carter et al. | 219/203 |

FOREIGN PATENT DOCUMENTS

| | | |
|---|---|---|
| 8502521 | 6/1985 | World Int. Prop. O. . |
| 8502649 | 6/1985 | World Int. Prop. O. . |

*Primary Examiner*—Teresa J. Walberg
*Assistant Examiner*—Tuan Vinh To
*Attorney, Agent, or Firm*—Oblon, Spivak, McClelland, Maier & Neustadt

[57] ABSTRACT

A window of a double glazing system includes a window frame formed in a wall of a room, a sash fitted in the window frame and an outer glazing mounted in the sash, all of which are conventional. A second glazing is mounted to the sash and at an interior position relative to the outer glazing, so as to form an air circulation space between the second and outer glazings. The second glazing is heated by a transparent electrical resistance layer formed thereon and apertures are formed in the sash to create an air circulation path from the outside, through the air circulation space into the room. As a result, fresh air circulating into the room is heated by the heated second glazing.

9 Claims, 3 Drawing Sheets

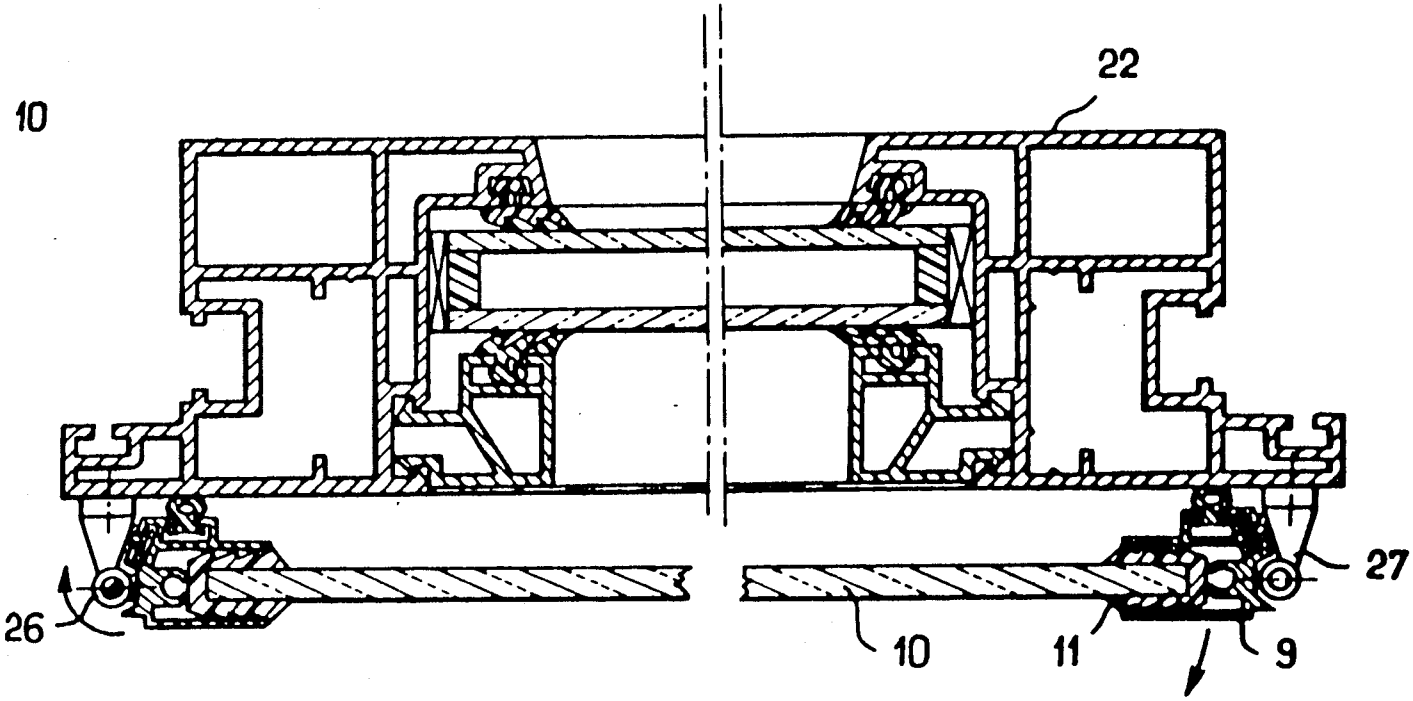
FIG_4
FIG_2
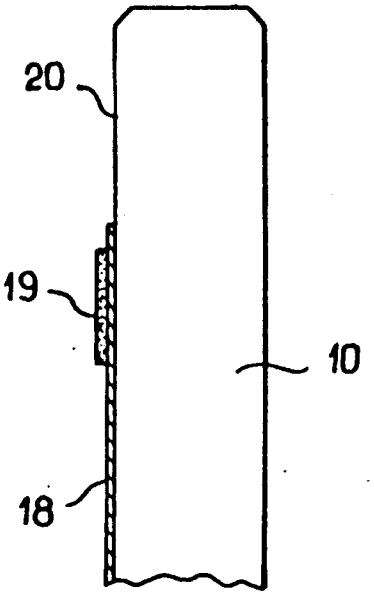

HEATED SECOND WINDOW IN A DOUBLE GLAZING SYSTEM

BACKGROUND OF THE INVENTION

1. Field of the Invention

The invention relates to a window comprising an interior glazing and an exterior glazing between which air circulates, the interior glazing being heated.

2. Description of the Related Art

The glazed walls of a building, i.e., the windows, are often considered to be components which allow, in winter, the escape of heat since their heat loss factor K is higher than that of the other walls. These glazed walls are thus cold walls, which brings about the consequence of a certain discomfort for persons in the vicinity of the glazed walls. Consequently, the floor spaces of the offices or accommodations located in the vicinity of the glazings are little used, hence a loss of the space that can actually be used.

Traditional means currently used to reduce such heat loss include the use of insulating glazings for the glazed parts and of thermally isolated sections for their frames. But these techniques have their limits and an altogether different technique has been proposed, i.e., the application of a "parietodynamic" insulation system to the glazed walls. In this system, fresh air taken from outside the room circulates on the inside of the glazed wall before being introduced in the room, which limits losses since this air enters the room after having been preheated by its passage within the wall.

However, it has been desired to improve this system further by combining it with a heating means. Accordingly it has been proposed, in particular in EP patent application No. 165,287, to equip such a glazed wall with means for providing air circulations past a heated glazing and in a direction toward the interior of the room. The cold wall effect has thus been corrected and it has even been possible to eliminate other equipment for heating the room. This is the case for U.S. Pat. No. 4,641,466 and French patent document No. 88.14009 which propose improving the energy efficiency of the system by limiting radiative heat exchange between the heated glazing and the outer glazed wall.

French patent application FR No. 2 611 029 shows a double or triple wooden window system which incorporates the various preceding functions. A frame and sash system designed especially for this type of application is also there described. While being well suited to the technical problem to be solved, this type of window is necessarily very costly since the solutions considered are complicated and require sash sections of large cross section, using considerable amounts of material. Further, these windows and therefore the sections that constitute them are specialized and usable exclusively for this particular and relatively limited use. Production runs are therefore short and the cost is consequently high.

SUMMARY OF THE INVENTION

An object of the present invention is to provide a system that makes it possible to transform traditional windows into heated windows with parietodynamic insulation.

To do this, the invention proposes equipping a traditional window with a heated interior second glazing. The heating is advantageously provided by a resistor that is located on the transparent surface of the second glazing.

In a variant, a conductive transparent layer constitutes the heating resistor, for example a layer of semiconductive metal oxide. Further, the latter is advantageously in contact with the air space.

The parietodynamic effect can be obtained according to the invention by providing the top and bottom crosspieces of the sashes with openings which make it possible for outside air to enter at the low part into the air circulation space and to be expelled at the high part toward the interior of the room. The partial vacuum in the interior of the room is produced by independent systems.

A characteristic of the invention also provides that when the second glazing is open, the electric power supply for its heating is automatically cut off.

The layers that heat the second glazing are one or more of the layers belonging either to the group of the layers pyrolyzed from powders and comprising the layers of tin oxide doped with fluorine and the layers of indium oxide doped with tin, or to the group of the layers obtained by vacuum cathode sputtering of a conductive metal between transparent dielectric layers.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 2 shows a heated glazing;

FIG. 4, the same window as in FIG. 3, in horizontal cross section.

DETAILED DESCRIPTION OF THE PREFERRED EMBODIMENTS

Figure 1:
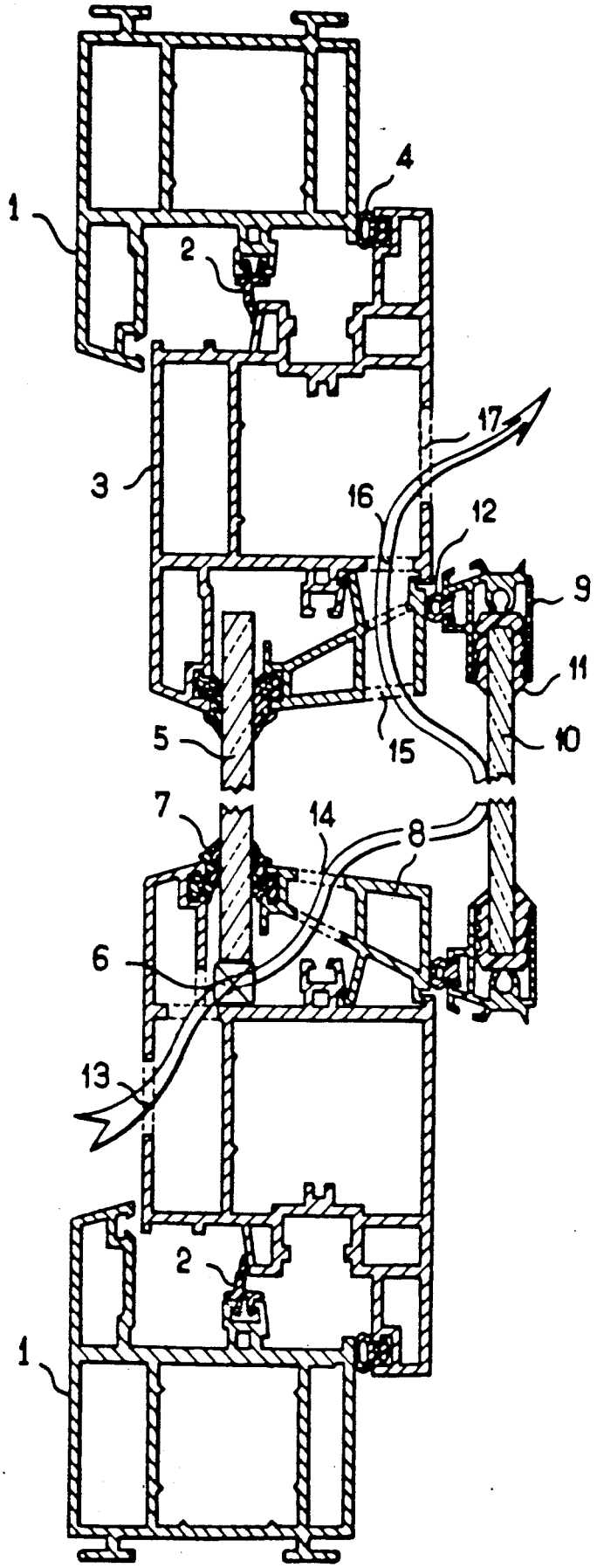
FIG. 1 shows a plastic window according to the invention in vertical cross section.

FIG. 1 shows a polyvinyl chloride (PVC) window according to the invention. It is composed of a window frame made of sections 1 fastened in the opening of the wall (not shown) by conventional fastening techniques. This window frame is equipped with elastomer seals 2 on which window sash 3 rests. The latter is composed of substantially identical sections on its four sides. It has, over its entire periphery, elastomer seals 4 which rest on the periphery of the window frame.

In a conventional way, the window sash is equipped with a glazing 5 installed on shims 6. It is held in place between elastomer seals 7 mounted to the sash and to a cover 8 which fits in housings of the sash.

The windows thus constituted are conventional windows.

The present invention is added to this conventional window and comprises three features which are, successively: the installation of an interior second glazing, the parietodynamic circulation of air, and the equipping of the second glazing as a heated glazing.

The second glazing structure is shown in FIG. 1. It consists of a frame section 9 that is metal or preferably of insulating material. This section frames a glazing 10 by means of an elastomer section 11. The frame section constitutes a frame that is welded, glued, or mechanically assembled at the corners thereof. It is airtightly mounted on cover 8, by elastomeric seals 12. Hinges (not shown in the figure) make is possible for the frame to pivot around a vertical axis. Likewise, on the vertical side opposite the one which supports the hinges, a standard latching system is installed. The pairing of the hinges and of the latches makes it possible to exert a pressure on the elastomer seals 12 and to assure a good airtightness between the window sash and the frame of the second glazing.

The circulation of air in the air circulation space between the two glazings 5 and 10 necessitates an intake duct, an exit duct and a difference in pressure between the outside and the inside of the room. The ducts are made by drilling and milling apertures through the sections of the window sash. This operation requires particular care since the cross section of the apertures must be sufficient in view of the volume of the room, the desired flow rate of fresh air (for example, a half room volume per hour) the number of windows according to the invention that the room has and the pressure loss in each of them, to allow the appropriate air renewal.

The position of the drillings through the various walls of the sections should enable the latter to keep their mechanical characteristics. In FIG. 1, the apertures have been shown only in the top and bottom crosspieces of the sash, at 13 for the passage from the outside into the sash section, at lower aperture 14 for the introduction into the air circulation space, at 15 for the exit from this space toward the sash section, at 16 for the horizontal crosspiece of the latter and at 17 for the return toward the interior of the room. In the Figure, all these apertures are shown in the same vertical plane. In reality, only lower aperture 14 must have a precise position and shape; it is a slot which occupies most of the width of the double glazing. At the upper part of the sash, the positioning of aperture 15 need be less exact because the hot air accmulates in this zone regardless of where this opening exits. Also, outside air apertures 13, horizontal crosspiece 16 and apertures 17 for the interior can, in contrast with what is shown in FIG. 1, be located anywhere on the surface of the sash frame, optionally on the uprights. The main criterion is that they have sufficient cross sections to provide adequate air flow while maintaining the mechanical strength for the sections.

To make the air circulate, it is obviously necessary that a pressure gradient exists between the outside and interior of the room. It is possible, as in U.S. Pat. No. 4,641,466 of FR No. 2 611 029, to incorporate the device which creates the internal vacuum in the window unit, but it is also possible and in general less expensive to use the existing controlled mechanical ventilation system for the building (or room). For this purpose, the total cross section of the aperture at each of the different levels for all the windows must have an area greater than the effective cross section of the ventilation system. The implementation of these apertures does not require any specialized technique, it could even—in the case of equipping existing windows—be performed on site after removal of the sashes.

The last element of the system proposed by the invention is the heated window (glazing) element itself; it is installed at 10 in the frame 9.

FIG. 2 shows in detail an example of a heated window element. A heat-tempered soda lime silica glass is seen at 10. It is covered with a conductive transparent layer 18 obtained for example by the process described in EP No. 125 153, i.e., a layer of tin oxide doped with fluorine with a surface resistance of, for example, 50 ohms per square meter.

On the layer 18, parallel to the large or small sides of the rectangle consisting of the glazing, are formed power lead-in strips 19 consisted of a conductive enamel, for example, with a silver base deposited by silk screen printing before tempering.

In a standard way, electric conductors, not shown, are soldered to these power lead-ins 19. The glazing of FIG. 2 is stripped of layer 18 at 20, along its edges. This makes the problems of electrical insulation easier, but this is not essential. It is possible to have the layer over the entire surface of the glazing, the nature of the peripheral seal (11, FIG. 1) and the care in mounting then guaranteeing a good electrical insulation.

Instead of the heated glazing of FIG. 2, any other type of glazing equipped with resistors on its surface can be used. It is possible, for example by silk screen printing of a silver paste, to have discrete conductors on the surface of a glass or, in another example, to use a transparent continuous layer of silver deposited by cathode sputtering and integrated into a laminated glazing whose interlayer is of polyvinyl butyral.

The electric power supply of the heated glazing is of a standard type. Generally, the electrical resistance of each heat glazing element is the same because, for reasons of cost, the glazing layer is produced in large quantities and generally by unit elements of large surface, after which the unit elements are cut, the power lead-in strips are formed and finally the glazing is tempered. It is not then possible to adjust the resistance of each element: such resistance is determined by the initial surface resistance and by the dimensions of the element. But on the other hand, it is necessary to be able to adapt the maximum electrical power capacity of the heated glazing to the current needs. This is especially true if the windows according to the invention constitute the only heating system for the room. It is then necessary that for the most intense cold, the input of heat is adequate and provides comfort to the occupants of the room. Therefore varying the value of the electric supply voltage will make is possible to assure this necessary nominal power.

But under these conditions, it is possible that the supply voltage will be higher than that with which the human body can come in contact without danger. Accordingly, in this case, the second glazing, if its conductive surface is accessable, will have to be equipped with safety systems which automatically cut off the power supply as soon as the opening of the double glazing occurs. This system, for example has been proposed in French FR No. 2 180 433.

The double glazing, further, is equipped with standard regulating systems that make it possible to adjust its temperature to instantaneous needs.

Figure 3:
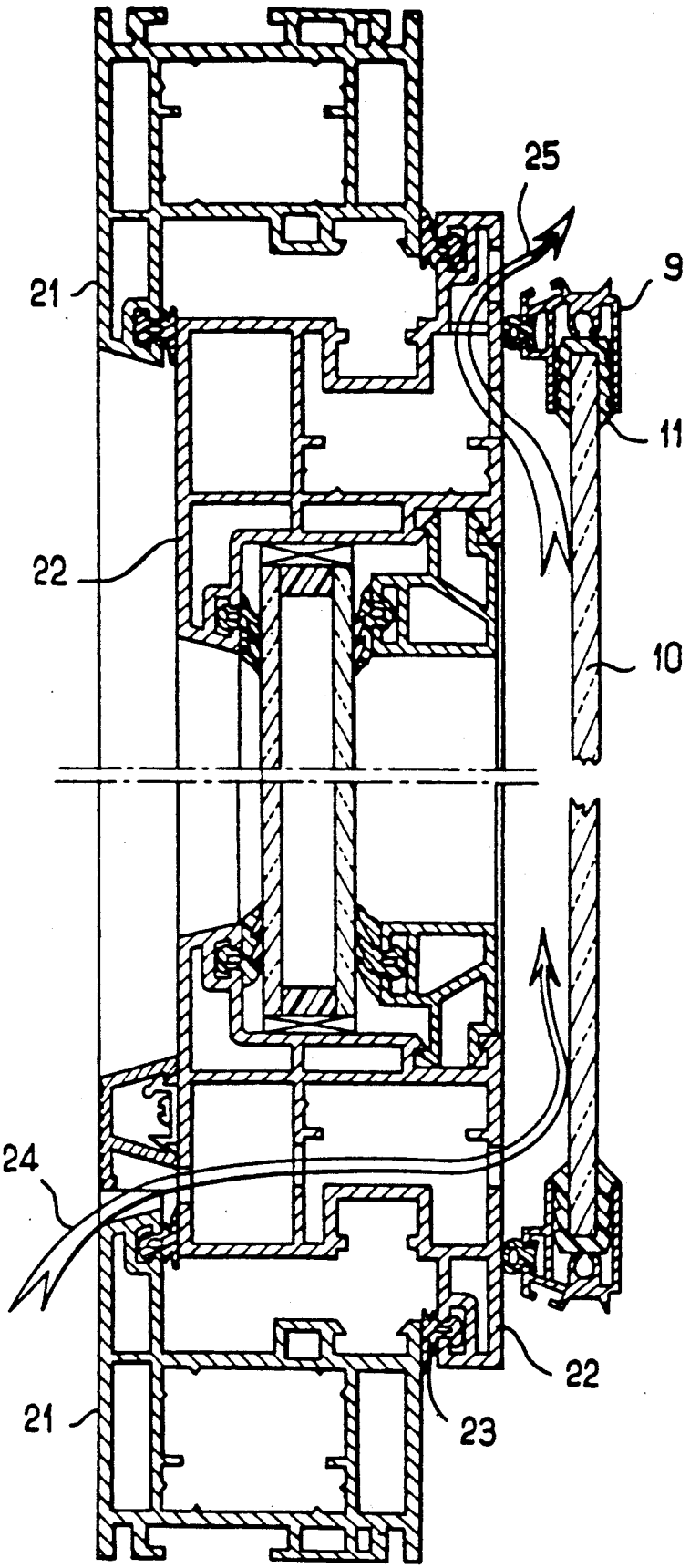
FIG. 3 shows another window consisting of plastic sections, also in vertical cross section.

FIG. 3 illustrates a vertical cross section of another type of window, also of PVC. Window frame 21 is fastened in the opening of the wall, not shown, and sash 22 rests by elastomer seal 23 on the window frame. The second glazing 9, 10 is identical with that of FIG. 1. Seen also in the Figure are the air intakes in the low part of the sash and the successive exit apertures that make it possible for air to exit from the space between the glazings after having circulated in the wall. Arrow 24 symbolically represents the passage of cold air at the low part, and arrow 25 the exit of warmer air at the high part.

As was the case in FIG. 1, the apertures made in the sash sections for the passage of air are all shown in the same vertical plane but actually, except for the fourth low aperture (in the order of passage of air) which must occupy the entire width of the double glazing, and except for the first high aperture which advantageously will occupy at least half the width (preferably on the outside edges), the position of the apertures is of little importance provided that their cross sections, considering the pressure losses, are sufficient (The preceding description, valid for plastic or aluminum sections obviously does not apply to wooden windows or windows with a frame of solid plastic or foam. In this case, it would require a continuity of the drillings so as to constitute a duct).

In FIG. 4, there has been shown sash section 22 of a window identical with the one of FIG. 3 but along a horizontal cross section which makes it possible to see how second glazings 9, 10 can be fastened to sash sections 22, in particular the hinge 26 and the latch 27 are seen.

Application of the window according to the invention can be performed in one of three different ways depending on whether it is a new construction, the reconditioning of a window or the adaptation of a window already installed. In the three cases, preliminary studies will have determined, depending on the type of window and the nature of its material, e.g., (wood, aluminum, PVC, etc.), the best suited way to make the drillings of the air intakes and exits. These will be made on the sashes on which the installation of the second glazings will also be made, the connections will be prepared both on the sashes—generally in the workshop—and in the room itself, on site, and in connection with the window frame. The sash-window frame connection being performed at the last moment.

The advantages of the system according to the invention are practical and economical. On the practical level, building skills are very traditional and installation techniques in one region are very different from those in another. The commercial preparation necessary for the introduction on the market of a completely new product is long and expensive. According, a system where one can add new functions (improvement of insulation, air renewal and heating) to an existing window system is very advantageous compared with the launching of a completely new multifunction system.

The economic advantages have already been mentioned; here the simplest possible components are used and both the window and the second glazing profit from the costs of mass production since they are both sold independently, and each in its own market: i.e., the market for new or reconditioned windows versus the market for double glazings.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A window comprising:

a window frame in a wall of a room;

a sash fitted in said window frame;

an outer glazing mounted in said sash;

a second glazing mounted to one of said frame, said sash and said outer glazing, and at position interior to said outer glazing, so as to form an air circulation space between said second and outer glazings;

means for heating said second glazing; and apertures in at least said sash and positioned for forming an air circulation path from outside said outer glazing, through said air circulation space and into the room, wherein said apertures comprise at least one lower aperture in a bottom crosspiece of said sash and at least one upper aperture in a top crosspiece of said sash, and wherein said at least one lower aperture comprises a single aperture extending substantially the width of the outer glazing and connecting said air circulation space with the outside, whereby fresh air circulating into the room is heated by said heating means.

2. The window of claim 1 wherein said heating means comprise a heating electrical resistor on a surface of said second glazing.

3. The window of claim 2 wherein said electrical resistor comprises a transparent layer.

4. The window of claim 3 wherein said transparent layer comprises a semiconductive metal oxide.

5. The window of claim 3 wherein said transparent layer is formed on a surface of said second glazing facing said outer glazing.

6. The window of claim 3 wherein said transparent consists of at least one layer formed of materials of the group consisting of pyrolized powders of tin oxide doped with fluoride and indium oxide doped with tin.

7. The window of claim 3 wherein said transparent layer comprises a plurality of sub-layers formed of a vacuum sputtered conductive metal layer sandwiched between transparent dielectric layers.

8. The window of claim 1 wherein said second glazing comprises a frame section air-tightly mounted to said sash and a glazing element fitted in said frame section.

9. The window of claim 8 wherein frame section is mounted to said sash via a hinge and a latch.

* * * * *